United States Patent [19]

Chu et al.

[11] Patent Number: 4,619,384

[45] Date of Patent: Oct. 28, 1986

[54] PRINTING OR DRAWING MOLD FOR STOCKINGS

[76] Inventors: Chia-Shih Chu; Chin-Lung Wu, both of 4 Fl., No. 7, Lane 89, Chang-Soon St., Taipei, Taiwan

[21] Appl. No.: 787,733

[22] Filed: Oct. 15, 1985

[51] Int. Cl.[4] ..... D06C 5/00

[52] U.S. Cl. ..... 223/77; 101/41

[58] Field of Search ..... 223/60, 77, 61, 74; 101/41, 42; 38/102.4

[56] References Cited

U.S. PATENT DOCUMENTS 2,620,100 12/1952 Duff et al. ..... 223/77

3,072,305 1/1963 Bryant, Jr. ..... 223/77

4,491,255 1/1985 La Chapelle ..... 223/77 X

*Primary Examiner*—Werner H. Schroeder

*Assistant Examiner*—Andrew M. Falik

[57] ABSTRACT

A printing or drawing mold for stocking includes a main mold having a pair of outer jacket plates, a pair of extendible side plates pivotedly formed on the main mold, a width adjuster formed on the upper portion of the mold operatively expanding the extendible side plates for the expansion of the stocking held on the mold and several printing beds formed on the main mold. When a stocking is placed over the main mold, decorative figures can be printed by the printing beds on the stocking or drawn directly thereon.

3 Claims, 7 Drawing Figures

PRINTING OR DRAWING MOLD FOR STOCKINGS

BACKGROUND OF THE INVENTION

Conventional knitted stockings or hosiery are usually made with a single color yarn or with different colored yarns forming integral designs such as a wave or diamond shape. However such designs are relatively simple and lack the appeal associated with a printed figure composed of many diverse colors.

SUMMARY OF THE INVENTION

The object of the present invention is to provide a mold for printing designs on a stocking including a main mold having a pair of outer jacket plates, an extendible mold having a pair of side plates and pivotedly formed on the main mold, a width adjuster having a pair of locking bars respectively formed on both side plates and adjustably engaged on a positioning rack formed on the outer jacket plate, and at least a pair of removable printing beds formed on the main mold, wherein the extendible mold can be adjustably extended by actuating the width adjuster to stretch the stocking on the main mold for printing the figures on the stocking when contacted by the printing beds or for directly drawing the figures on the stocking positioned over the main mold.

DETAILED DESCRIPTION

Figure 1:
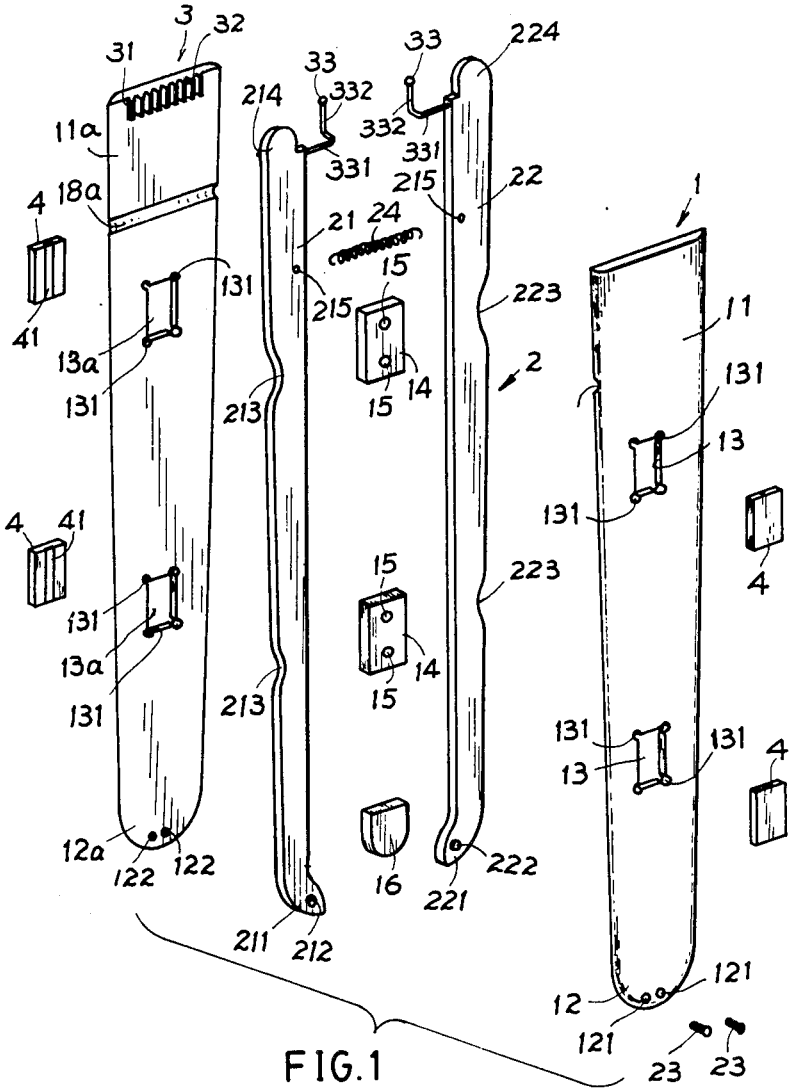
FIG. 1 is an illustration showing all parts of the present invention.
Figure 2:
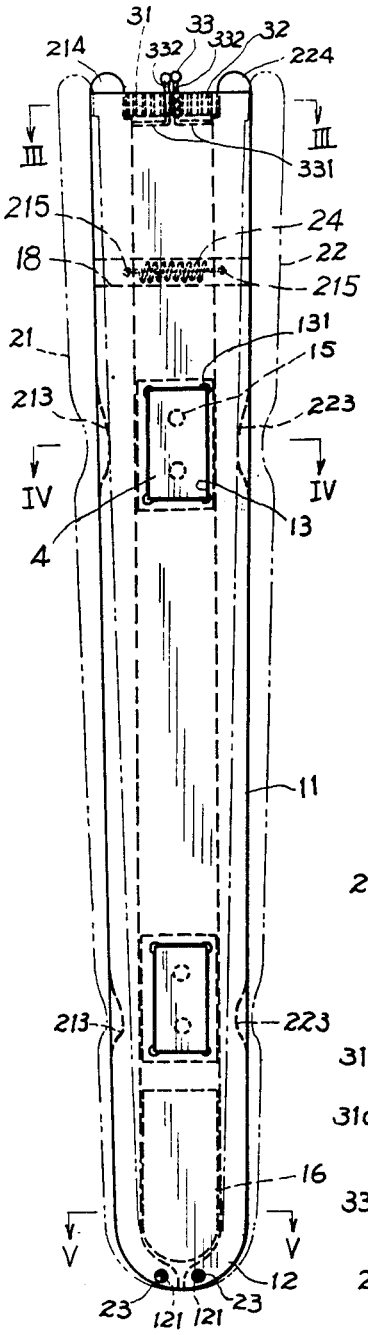
FIG. 2 is a front-view drawing of the present invention.
Figure 3:
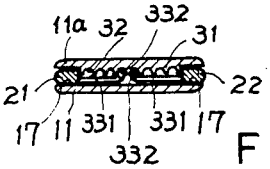
FIG. 3 is a side-view sectional drawing of the present invention taken on line III—III of FIG. 2.
Figure 4:
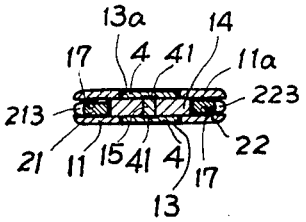
FIG. 4 is a sectional drawing of the present invention taken on line IV—IV of FIG. 2.
Figure 5:
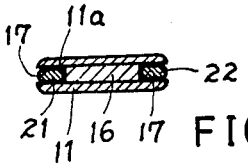
FIG. 5 is a sectional drawing of the present invention taken on line V—V of FIG. 2.

As shown in FIGS. 1-5, the present invention comprises: a main mold 1, an extendible mold 2, a width adjuster 3 and at least a pair of printing beds 4 formed on the main mold 1.

The main mold 1 includes a pair of outer jacket plates 11, 11*a*, each plate 11 or 11*a* being formed as a lengthy tapered plate having lower arched end 12 or 12*a*. Two pin holes 121 or 122 are formed on the lower portion of each plate 11 or 11*a*. The plate 11 is formed with at least two openings 13 each having four holes 131 disposed on the four corners of each opening 13. Another corresponding plate 11*a* is also formed with at least two openings 13*a* corresponding to the openings 13. Each pair of openings 13, 13*a* are adapted for the insertion of said pair of printing form beds 4 each having a size equivalent to that of opening 13 or 13*a*.

The extendible mold 2 includes a pair of side plates 21, 22, each side plate being formed with a pin hole 211 or 221 on its lower portion and several recess portions 213 or 223 on its middle portion and a locking bar 33 on its upper portion 214 or 224.

The width adjuster 3 includes a positioning rack 31 transversely formed with a plurality of teeth 32 and a pair of locking bars 33 each having a horizontal lever 331 and a vertical lever 332 and each formed on the inner side of the upper portion 214 or 224 of the plate 21 or 22 to face the opposite bar formed on the other plate. Each vertical lever 332 can be adjustably locked on the teeth 32 of rack 31.

The two side plates 21, 22 of extendible mold 2 are pivotedly fixed on the lower portion of the two outer jacket plates 11, 11*a* respectively by two screws 23. A lower partition block 16 is inserted between the two plates 11, 11*a* and has a thickness equal to the separating distance 17 between the two plates 11, 11*a*. The thickness of each side plate 21 or 22 is also equal to the distance 17 between the two plates 11, 11*a*.

Each removable printing bed 4 is fixed with a ferrous plate 41 on its inner surface. Each bed 4 is engageably fixed into the opening 13 or 13*a* on plate 11 or 11*a*. Between the two beds 4, there is provided a sandwiched magnetic block 14 fixed with the magnets 15 so that the block 14 with the magnetic 15 will be attracted and secured to the ferrous plates 41 each formed on the inner side of each bed of the two beds 4 facing each other. The drawings show a pair of blocks 14 associated with the two pairs of beds. The thickness of the lock 14 should also be equal to the distance 17 between the two plates 11, 11*a*. A restoring spring 24 is secured to both side plates 21, 22 at the connection points 215, 225. Two sockets 18, 18*a* are respectively formed on the two outer plates 11, 11*a* for disposing the spring 24 in the sockets.

When using the present invention, the stocking is fitted onto the main mold 1 and the width adjuster 3 is operated to adjustably extend the locking bars 33 outwards to engage on the specific rack teeth 32 to expand the stocking for printing figures on the stockings by the beds 4 secured on the two plates 11, 11*a* of main mold. The size of each bed 4 is not limited in this invention and can be modified to be adapted for the specific printing area or styles. Whenever changing the bed 4 for a different printing style, a tool (not shown) can be used to pick up the used bed from the four-cornered opening 13 or 13*a* for the replacement of new bed.

Figure 6:
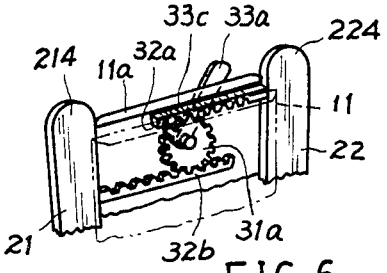
FIG. 6 is a partial drawing of another preferred embodiment of the present invention.

Another preferred embodiment of the present invention is shown in FIG. 6 in which the width adjuster 3 is modified as a pair of racks 32*a*, 32*b* respectively secured to the side plates 22, 21 and movably engaged with a gear wheel 31*a* having an adjusting rod 33*a*. The adjusting rod 33*a* is operated to rotate the gear wheel 31*a* to relatively move the two racks 32*a*, 32*b* to extend the two side plates 21, 22 for expanding or stretching the stocking to the desired width. The upper rack 32*a* is formed with a scale 33*c* to indicate the adjusted width.

Figure 7:
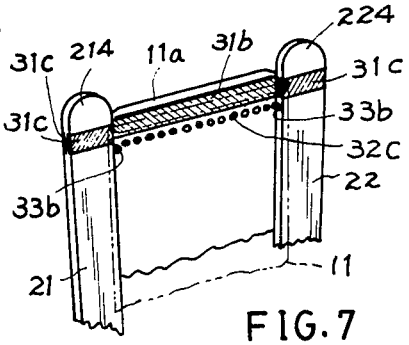
FIG. 7 shows still another preferred embodiment of the present invention.

Still another preferred embodiment of the present invention is shown in FIG. 7 in which the width adjuster 3 is modified to include a plurality of pin holes 32*c* on the upper portion of one outer plate 11*a*. Two pins 33*b* can be adjustably inserted into the pin holes 32*c* to obstruct or prevent the side plates 21, 22 from moving inward beyond the width defined between the two pins 33*b*. For stable expansion and positioning of the plates 21, 22, the upper portion of the outer plate 11*a* and either upper portion of the two side plates 21, 22 are respectively fixed with magnetic metal strips 31*b*, 31*c* for mutual attraction among the main plate 11*a* and the side plates 21, 22.

We claim:

1. A printing mold for a stocking comprising:

a main mold including a pair of outer jacket plates each formed as a lengthy tapered plate having a lower arched portion and formed with at least a pair of openings adapted for the insertion of two removable form beds therein;

an extendible mold including a pair of side plates secured by a restoring spring and each side plate having a lower portion pivotedly fixed on said main mold by a screw; a width adjuster for causing said side plates to pivot whereby a stocking fitted over said main mold can be expanded or stretched for a printing operation including a positioning rack having teeth transversely formed on said rack formed on an upper portion of one said outer jacket plates and a pair of locking bars each located on an inner side of an upper portion of each of said side plates so that they face each other, each locking bar adjustably engaged with the teeth of said rack;

at least a pair of printing beds, each having a ferrous metal plate fixed on an inner surface of said bed and inserted within each of the openings formed on at least one of said outer jacket plates of said main mold;

at least one magnetic block located between each of said two beds and having magnets fixed thereon to be attracted by said printing beds having the ferrous metal plate fixed thereon, the thickness of said block defining a separating distance between said two outer jacket plates; and a lower partition block inserted between said two outer jacket plates and having a thickness equal to the said separating distance.

2. A printing mold for a stocking comprising:

a main mold having a pair of outer jacket plates with at least a pair of openings on each plate; an extendible mold having a pair of side plates, each said side plate pivotedly fixed on said main mold;

a width adjuster; and at least a pair of printing beds each inserted within the openings formed on either one of said outer jacket plates;

said width adjuster including a pair of racks respectively secured to said two side plates, and a gear wheel having an adjusting bar and rotatably engaged with said two racks for operatively adjusting the separating distance between said two side plates.

3. A printing mold for a stocking comprising:

a main mold having a pair of outer jacket plates with at least a pair of openings on each plate;

an extendible mold having a pair of side plates pivotedly fixed on said main mold; and at least a pair of printing beds each inserted in the openings on either one of said outer jacket plates;

one of said outer jacket plates having a plurality of pin holes transversely formed on the upper portion of said outer plate, and a pair of pins adjustably inserted into two said pin holes to obstruct said two side plates beyond the distance as defined by said two pins.

* * * * *